US011846913B2

(12) United States Patent
Renaud

(10) Patent No.: US 11,846,913 B2
(45) Date of Patent: Dec. 19, 2023

(54) ESCAPEMENT MECHANISM WITH LOCKING ANCHOR AND TIMEPIECE PROVIDED WITH SUCH AN ESCAPEMENT MECHANISM

(71) Applicant: François Besse, Nyon (CH)

(72) Inventor: Dominique Renaud, Morges (CH)

(73) Assignee: François Besse, Nyon (CH)

( * ) Notice: Subject to any disclaimer, the term of this patent is extended or adjusted under 35 U.S.C. 154(b) by 540 days.

(21) Appl. No.: 17/048,323

(22) PCT Filed: Apr. 17, 2019

(86) PCT No.: PCT/EP2019/059884
§ 371 (c)(1),
(2) Date: Nov. 4, 2020

(87) PCT Pub. No.: WO2019/201976
PCT Pub. Date: Oct. 24, 2019

(65) Prior Publication Data

US 2021/0149342 A1 May 20, 2021

(30) Foreign Application Priority Data

Apr. 17, 2018 (EP) ..... 18167638

(51) Int. Cl.
*G04B 15/08* (2006.01)
*G04B 15/10* (2006.01)
*G04B 15/14* (2006.01)

(52) U.S. Cl.
CPC ..... *G04B 15/08* (2013.01); *G04B 15/10* (2013.01); *G04B 15/14* (2013.01)

(58) Field of Classification Search
CPC ..... G04B 15/08; G04B 15/10; G04B 15/14
See application file for complete search history.

(56) References Cited

U.S. PATENT DOCUMENTS 2,531,273 A * 11/1950 Jaccard ..... G04B 15/02 368/134
9,098,067 B2 8/2015 Koda et al.
(Continued)

FOREIGN PATENT DOCUMENTS

CH 101849 A 11/1923
CH 693 805 2/2004
(Continued)

OTHER PUBLICATIONS

International Search Report for PCT/EP2019/059884 dated Jul. 24, 2019, 6 pages.
(Continued)

*Primary Examiner* — Edwin A. Leon
*Assistant Examiner* — Kevin Andrew Johnston
(74) *Attorney, Agent, or Firm* — NIXON & VANDERHYE

(57) ABSTRACT

Disclosed is an escapement mechanism with a locking anchor for a timepiece including a sprung-balance regulating organ, including an escapement wheel provided with a series of peripheral teeth, and a locking anchor including first and second locking pallets arranged respectively at one end of first and second arms to allow alternately engaging a tooth of the escapement wheel at each rotation step of the escapement wheel and of the anchor about their respective axis of rotation. This mechanism includes an impulse pallet adapted to be fixed to one the regulating organ to transmit an impulse by sliding a tooth of the escapement wheel on an impulse plane of the impulse pallet once at least every two oscillations of the regulating organ while the locking anchor includes a connecting member for permanent kinematic engagement in rotation to the regulating organ. Also disclosed is a timepiece incorporating such an escapement mechanism.

20 Claims, 7 Drawing Sheets

(56) References Cited

U.S. PATENT DOCUMENTS

| | | | | |
|---|---|---|---|---|
| 2008/0259738 | A1* | 10/2008 | Cabezas Jurin | G04B 17/063 368/131 |
| 2012/0014228 | A1* | 1/2012 | Colpo | G04B 15/06 368/131 |
| 2015/0220061 | A1* | 8/2015 | Stranczl | G04B 15/14 368/132 |

FOREIGN PATENT DOCUMENTS

| | | | | |
|---|---|---|---|---|
| EP | 1 045 297 | | 10/2000 | |
| EP | 1045297 | A1 * | 10/2000 | G04B 15/08 |
| EP | 1 983 391 | | 10/2008 | |
| EP | 2 407 830 | | 1/2012 | |
| EP | 2 871 535 | A1 | 5/2015 | |
| JP | 2015-025719 | A | 2/2015 | |
| JP | 2015-090366 | A | 5/2015 | |
| WO | 2016/012281 | | 1/2016 | |

OTHER PUBLICATIONS

Written Opinion of the ISA for PCT/EP2019/059884 dated Jul. 24, 2019, 6 pages.

* cited by examiner

ESCAPEMENT MECHANISM WITH LOCKING ANCHOR AND TIMEPIECE PROVIDED WITH SUCH AN ESCAPEMENT MECHANISM

TECHNICAL FIELD

The present invention relates to the field of watchmaking. It concerns, more particularly, an escapement mechanism with a dragging locking anchor with impulses separated from the lockings by means of a locking fork capable of being arranged in kinematic engagement with a regulating organ of a timepiece.

The invention also concerns a timepiece comprising such an escapement mechanism cooperating with a suitable regulating organ, in particular of the sprung balance or knife oscillator type.

STATE OF THE ART

In the field of watchmaking, dragging or rubbing locking escapements have long been known, which were developed and are still used today, particularly in clocks, whose regulating organ consists of a pendulum. This type of escapement comprises a device, generally integral with the regulating organ of the timepiece that contains it, which is in permanent contact with the escapement wheel during the locking phases. As a result, it has a poor efficiency and singularly alters the isochronism of a regulating organ of the sprung balance type, which makes it particularly unsuitable for distributing the motive energy within movements of pocket watches or wristwatches mainly comprising this type of regulating organ.

However, these escapements are interesting because they are relatively simple to use, less sensitive to operating disturbances such as shocks, and they are suitable for small amplitudes of controller movement, with reduced lift angles.

The present invention is intended to provide a new locking anchor escapement of improved efficiency, comprising a minimal angle of lift on the regulating organ in order to make it viable for use in a mechanical watch movement but which does not suffer from the limitations of known rubbing locking anchor escapements.

Another purpose of the invention also concerns the proposal for a timepiece with such an escapement.

DISCLOSURE OF THE INVENTION

Thus, according to a first object, the present invention proposes an escapement mechanism with a locking anchor for a timepiece comprising a regulating organ, the escapement mechanism comprising:

- an escapement wheel rotatable about a first axis of rotation and having a series of peripheral teeth, and
- a locking anchor, rotatable about a second axis of rotation parallel to the first, said anchor comprising first and second locking pallets arranged respectively at one end of first and second arms and capable of alternately engaging a tooth of the escapement wheel at each rotation step of the escapement wheel and of the anchor about their respective axis of rotation.

In accordance with the invention, the escape mechanism further comprises at least one impulse pallet adapted to be fixed to a said regulating organ to transmit an impulse by sliding a tooth of the escapement wheel on an impulse plane of said impulse pallet once at least every two alternations of said regulating organ, while the locking anchor comprises a connecting member for permanent kinematic engagement in rotation to said regulating organ so as to provide a lever arm between the axis of rotation of the regulating organ and the escapement wheel.

The escapement mechanism of the present invention is thus similar to a Graham type escapement, commonly used in clocks, but with a locking anchor distinct from the impulse pallet(s), itself capable of being attached to a regulating organ of a timepiece, in particular a sprung balance as commonly used in watches, or of the knife resonator type described in the Applicant's patent application WO2016/012281.

This results in a locking anchor escapement configuration by which the impulse and locking phases are separated, with considerably reduced locking friction compared to the rubbing locking escapement of the anterior art, during all phases of course by the regulating organ of its additional arc. Moreover, as the locking anchor is in permanent connection with the regulating organ, only the movement of the latter participates in the pivoting of the locking anchor and thus in the unlockings of the escapement wheel. This reduces the draw effects encountered in conventional anchor escapements, as well as significantly reducing the friction, and hence the disturbance to the balance known from the locking anchor escapements known from earlier art, and hence the isochronism of the watch movement incorporating said escapement.

The escapement mechanism of the invention can also advantageously be a single-beat escapement, which reduces the "dragging" impulse phases to one impulse every two alternations of the regulating organ, while ensuring periodic unlockings at the desired frequency of the regulating organ.

The escapement mechanism of the invention is further secured by the provided permanent connection of the locking anchor to the regulating organ, which prevents any overbanking and jamming in small angular amplitudes of movement of the regulating organ.

According to an advantageous feature of the invention, the locking anchor and the at least one impulse pallet are arranged opposite the escapement wheel in such a way that, in a position known as "dead centre", i.e. outside the locking or impulse phases, the locking pallets are located at a distance from the axis of rotation of the escapement wheel greater than the radius of the circle circumscribed by the teeth of said escapement wheel, while at least one end of the at least one impulse pallet is located at a distance from the axis of rotation of the escapement wheel less than said radius. Consequently, it is easy to understand that in a "dead centre" position, the locking pallets are distant from the teeth of the escapement wheel at the periphery of the latter, whereas the impulse pallet or pallets extend at least partially between said teeth of the escapement wheel.

This particular escapement arrangement makes it possible in particular to ensure a self-starting character to the escapement mechanism of the present invention since the torque of the regulating organ is sufficient, by the effect of the lever arm provided by the locking anchor between the axis of rotation of the regulating organ and the escapement wheel, to release the escapement wheel, which will be able to engage an impulse plane of an impulse pallet under the driving action of the finishing gear train of a watch movement with which it is associated without contact with the locking pallet, previously unlocked by the rotation of the locking anchor induced by the regulating organ.

According to a particular embodiment, the teeth of the escapement wheel are thicker, for example, by approximately twice as much as the felloe of the escapement wheel from which they extend. This makes it possible in particular to ensure, during the impulse phases, a secure support of a tooth on the impulse plane of an impulse pallet and the free passage of said impulse pallet above the felloe between two teeth during the course of the additional arc of the regulating organ on which said impulse pallet must be arranged when using the inventive escapement mechanism in a timepiece.

According to a particular embodiment, the locking anchor comprises a connecting member for permanent kinematic engagement to a said regulating organ arranged at the end of an arm extending opposite the locking pallets, said connecting member comprising a slide capable of receiving a pin, stud, lug or the like intended to be fixed to a said regulating organ in order to produce a sliding pivot connection between the locking anchor and said regulating organ.

Advantageously, said slide can be machined into the mass at the end of the connecting member of the locking anchor, for example in the form of a closed or open groove or recess, thus forming a connecting fork shape.

In a special embodiment, the escapement mechanism has a single impulse pallet. The escapement of the invention is then a single-beat escapement.

In another embodiment, the escapement mechanism comprises two impulse pallets capable of being fixed symmetrically on a said regulating organ with respect to a straight line passing through the axes of rotation of said regulating and escapement wheel.

In accordance with a second object, the present invention also provides a timepiece, in particular a watch, comprising a watch movement equipped with a mechanical driving source, a finishing gear train, a regulating organ and an escapement mechanism according to the invention arranged in kinematic engagement by its escapement wheel to the finishing gear train on the one hand and by the connecting member of the locking anchor to said regulating organ on the other hand, at least one impulse pallet of said escapement mechanism being furthermore fixed on said regulating organ in order to periodically receive a share of mechanical energy from the driving source per dragging impulse of a tooth of the escapement wheel on an impulse plane of the impulse pallet.

A final object of the present invention furthermore concerns the proposal of a regulating organ for a timepiece adapted to work in conjunction with the escapement mechanism previously described. In particular, the regulating organ according to the invention can advantageously be a sprung balance assembly comprising an impulse pallet or two impulse pallets projecting from the balance felloe, fixed on said balance.

BRIEF DESCRIPTION OF THE DRAWINGS

Other details of the invention will become clearer on reading the following description, with reference to the attached drawings in which.

MODES OF CARRYING OUT THE INVENTION

The present invention proposes a new type of escapement for timepieces comprising a locking anchor and separate impulse pallets, and arranged in such a way that the lockings are separated from the impulses, in order to reduce the known problems of dragging locking escapements known from the previous art.

The escapement of the present invention has an extremely simple structure of construction and compactness, compatible with the use of regulating organs of the sprung balance type classically employed in pocket watches or wristwatches but with lower amplitudes of balance oscillations, and therefore higher frequencies, without significantly disturbing the isochronism thereof.

Figure 1:
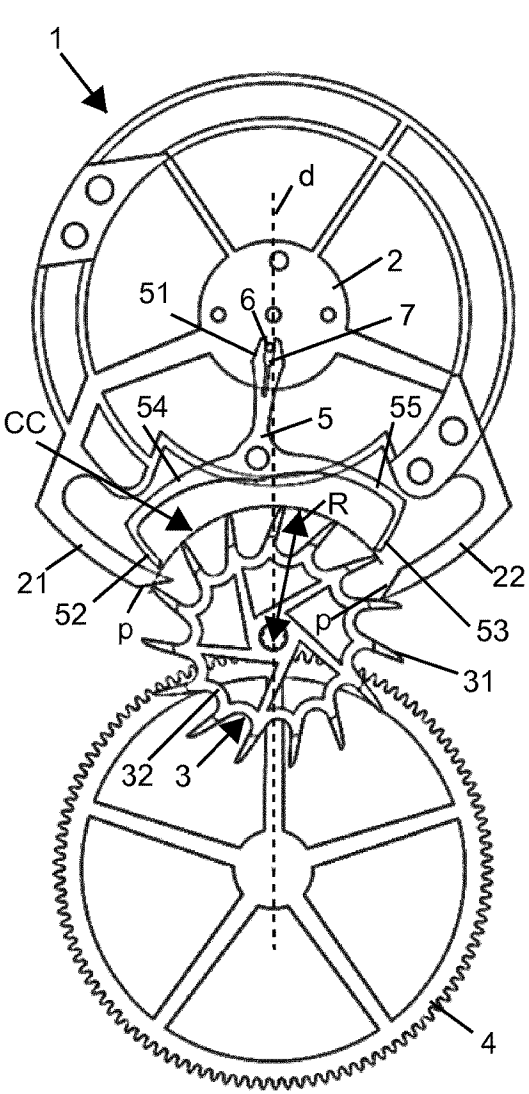
FIG. 1 represents an escapement mechanism according to the present invention in a neutral position known as "dead centre", outside the locking or impulse phases, at a regulating organ of the sprung balance type, of which only the balance is represented in the figure.
Figure 6:
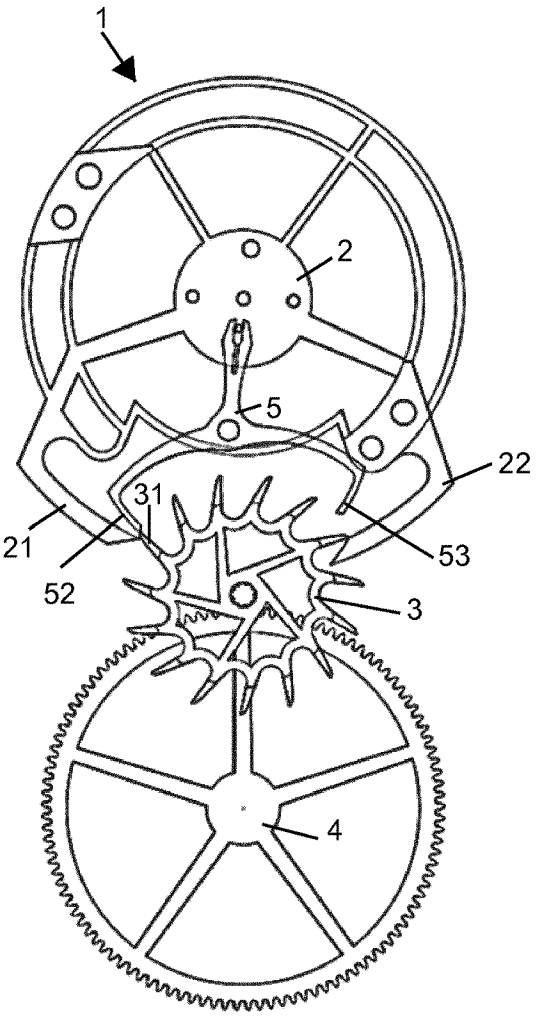
Figure 5:
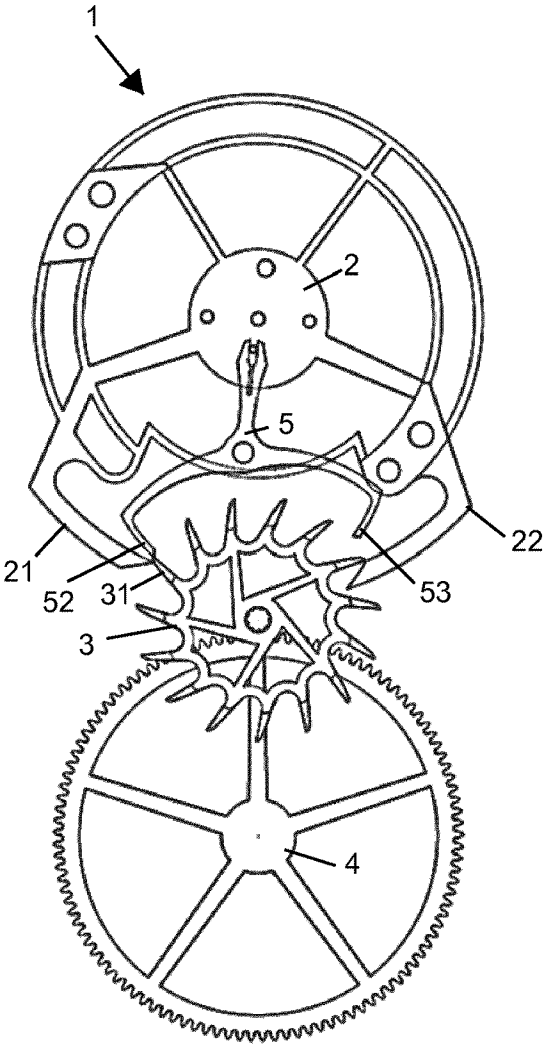

A first particular embodiment of the escape mechanism 1 of the invention is thus represented in FIG. 1, in a position known as "dead centre", outside the impulse or locking phases. For the sake of simplification and clarity of representation, the escapement mechanism 1 is depicted in this (and subsequent) FIG. 1 in cooperation with a balance, part of a regulating organ 2 of the sprung balance type, the balance-spring of which is not depicted, and a wheel 4 of a finishing gear train of a watch movement. Regulating organ 2 could also be of the knife resonator type, as proposed by the applicant in patent application WO 2016/012281. FIGS. 2 to 9 then show the various operating phases of the inventive escapement over a complete oscillation of the balance 2.

The escapement mechanism 1 of the present invention thus comprises in the first place an escapement wheel 3 rotatable about a first axis about which is also driven an escapement pinion (not shown) allowing the escapement wheel 3 to be coupled to a terminal wheel 4 of the finishing gear train of a watch movement. Escapement wheel 3 has a series of peripheral teeth 31 extending, in a conventional manner, from a felloe 32 of escapement wheel 3. Preferably, the teeth 31 have at their free end a thickness, measured in the plane of the escapement wheel 3 in which the felloer 32 and the teeth 31 extend, perpendicular to the axis of rotation of the escapement wheel 3, which is greater than that of the felloe 32. This difference in thickness between the teeth 31 and the felloe 32 of the escapement wheel is represented schematically in the figures by a shoulder line near the foot of each tooth 31. This increased thickness of the teeth in relation to the rest of the wheel provides, as will be shown later, an ability for the escapement wheel 3 to cooperate alternately with a locking anchor 5 and impulse pallets 21, 22 fixed on the balance of the regulating organ 2 mobile in parallel planes superimposed and secant to said teeth 31.

The escapement mechanism 1 therefore also comprises a locking anchor 5, inserted between the balance of the regulating organ 2 and the escapement wheel 3, and two impulse pallets 21, 22, advantageously fixed on the balance of the regulating organ 2, by any appropriate means, in particular by gluing or screwing, or made of material in the mass of the balance during the manufacture of the latter and then machined. The impulse pallets 21, 22 are preferably arranged on the regulating organ 2 symmetrically with respect to a straight line d passing through the axes of rotation of said regulating organ 2 and escapement wheel 3 in said "dead centre" position shown in FIG. 1, thus giving the regulating organ 2 the appearance of an anchor. The impulse pallets 21, 22 each have an impulse plane p which, in the "dead centre" position (FIG. 1), intersects the circumcircle cc of the teeth 31 of the escapement wheel 3.

However, as will be described in more detail below, the impulse pallets 21, 22 only intervene within the framework of the mechanism of the invention for the impulse phases from the escapement wheel 3 to the balance of the regulating organ 2 and not for the locking phases, the latter being carried out exclusively by the locking anchor 5. The latter is mobile in rotation around an axis of rotation parallel to the axes of rotation of the regulating organ 2 and the escapement wheel 3. Locking anchor 5 has first and second locking pallets 52, 53 arranged at one end of first and second arms 54, 55, respectively. These locking pallets 52, 53 are adapted to engage alternately in a first and a second locking position, by displacement induced directly and exclusively by the balance of the regulating organ 2, a tooth 31 of the escapement wheel 3 at each step of rotation of the latter. The locking anchor 5 also has a connecting member 51 for permanent kinematic engagement to the regulating organ 2.

Said connecting member 51 for permanent kinematic engagement to the regulating organ is advantageously shaped at the end of an arm extending away from the locking pallets 52, 53 into a slide 7 capable of receiving a male sliding connection element such as a pin 6, or a stud, lug or the like driven onto the regulating organ 2 in order to produce a sliding pivot connection between the locking anchor 5 and the regulating organ 2. Slide 7 can be made in various shapes. For example, it can be machined into the mass at the end of connecting member 51 of the locking anchor 5, in the form of a straight, closed groove or recess, or in a Y-shape to allow the regulator to travel over 90°, in particular. Alternatively, as shown in the figures, it may also consist of a notch or recess, machined or formed in the mass of the locking anchor 5 according to its material, forming a two-toothed connecting fork on either side of the notch, in which the connecting pin 6 to the regulating organ 2 can slide. In any event, the slide 7 and the pin 6 are arranged on the locking anchor 5 and the regulating organ 2 in such a way that said pin 6 is arranged and moves, during operation of the escapement mechanism 1, inside the slide 7 and is permanently in contact with the walls of the latter, in all positions of the balance of the regulating organ 2, as opposed to the interaction of an anchor with the balance pin in conventional prior art escapement mechanisms.

As stated above, the locking anchor 5 is arranged in relation to the regulating organ 2 and the escapement wheel 3 in such a way that, in the dead centre position of the escapement shown in FIG. 1, its axis of rotation is parallel to the axes of rotation of the regulating organ 2 and of the escapement wheel 3. In addition, still in this dead centre position, the locking anchor 5 must be such that the locking pallets 52, 53 are located at a distance from the axis of rotation of the escapement wheel greater than the radius R of the circumcircle cc of the teeth 31 of the escapement wheel 3, when at the same time the ends of the impulse pallets 21, 22 intersect said circumcircle cc, and are thus located at a distance from the axis of rotation of the escapement wheel 3 less than the radius R.

By this configuration, at the dead centre of the escapement 1, the impulse planes p of the impulse pallets 21, 22 are located on the path of the teeth 31 of the escapement wheel 3 materialized by the circle cc, whereas the locking pallets 52, 53 are located outside this path. Also, the rotation of the escapement wheel 3 necessarily leads to the engagement by a tooth 31 of an impulse plane p of an impulse pallet 21, 22 and the driving, by sliding of tooth 31 on this impulse plane p, of the balance of the regulating organ 2 in oscillation around its axis. The escapement 1 is thus self-starting, and facilitated by the lever arm effect of the locking anchor between the escapement wheel and the balance. In fact, the permanent connection by connecting member 51 of the locking anchor 5 to the balance induces, as soon as the balance starts to rotate, a driving moment of the locking anchor 5 around its axis applied to the point of contact between pin 6 and slide 7 of the permanent connecting member. Thus, even a very small angular displacement of the balance, whose angular amplitude in relation to the straight line d is in practice at most in the range of 90° to 150°, makes it possible, by means of a lever arm effect between the connecting member 51 and the axis of rotation of the locking anchor, to actuate the alternating tilting motion, at the balance frequency of the locking anchor 5, and the displacement of the locking pallets 52, 53 of the latter between two locking positions against the teeth 31 of the escapement wheel 3 during the course of the additional arc of the balance, during which none of the impulse planes is in contact with the teeth 31 of the escapement wheel 3. The escapement mechanism 1 of the present invention therefore provides very low rubbing lockings separated from the impulses, with impulses, even at low oscillation amplitude, of the balance of the regulating organ 2.

The operation of the escapement mechanism of the invention on a full oscillation of the regulating organ 2 is shown in FIGS. 2 to 9 and described below. By convention, the directions of rotation of the balance of the regulating organ, the locking anchor and the escapement wheel shall be described as clockwise or anticlockwise, respectively, with reference to the planar representations of each of the figures.

Figure 3:
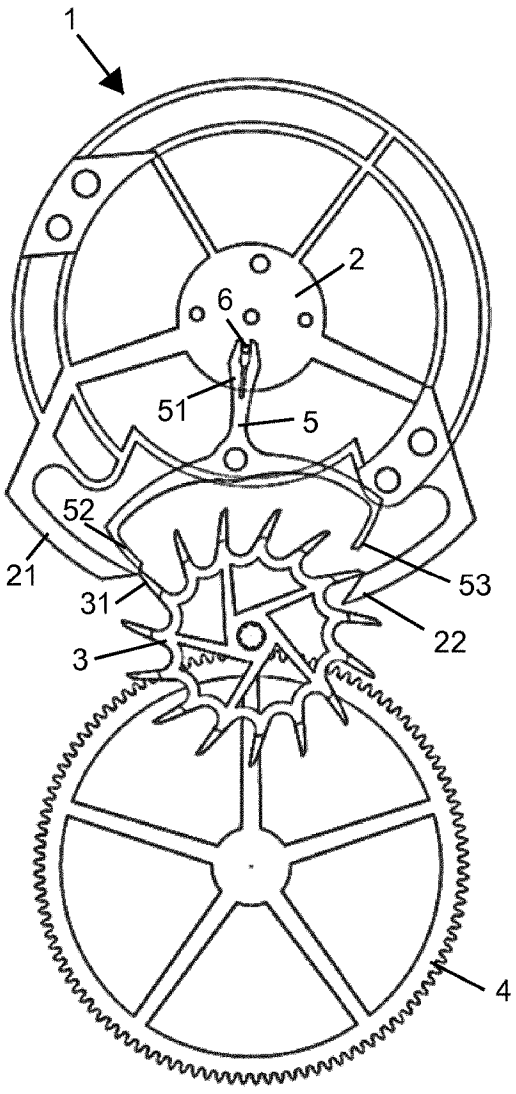
FIGS. 2 to 9 show the escapement of FIG. 1 in different positions and operating phases over a complete oscillation of the balance of the associated control device.
Figure 2:
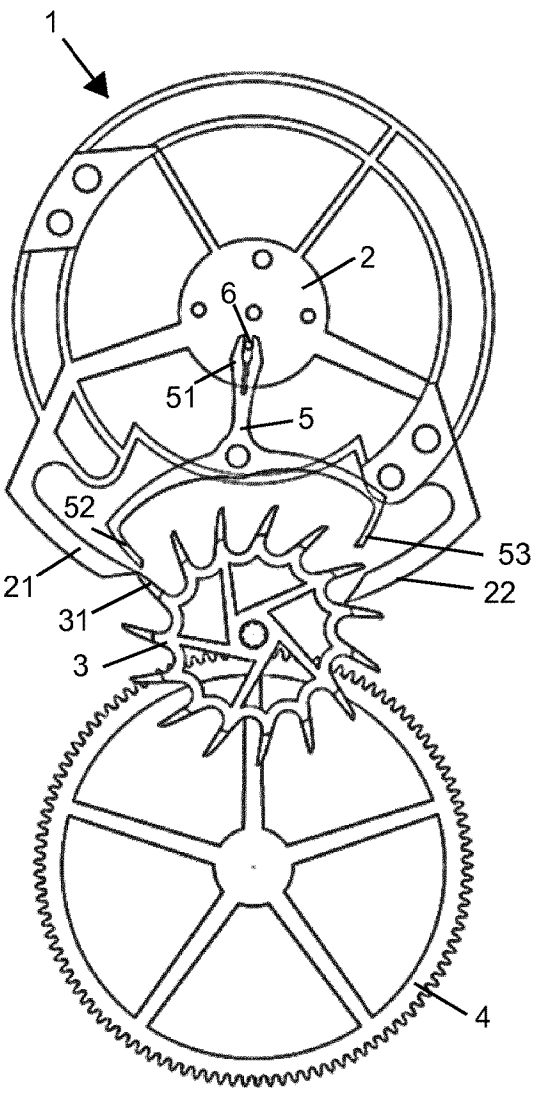
Figure 4:
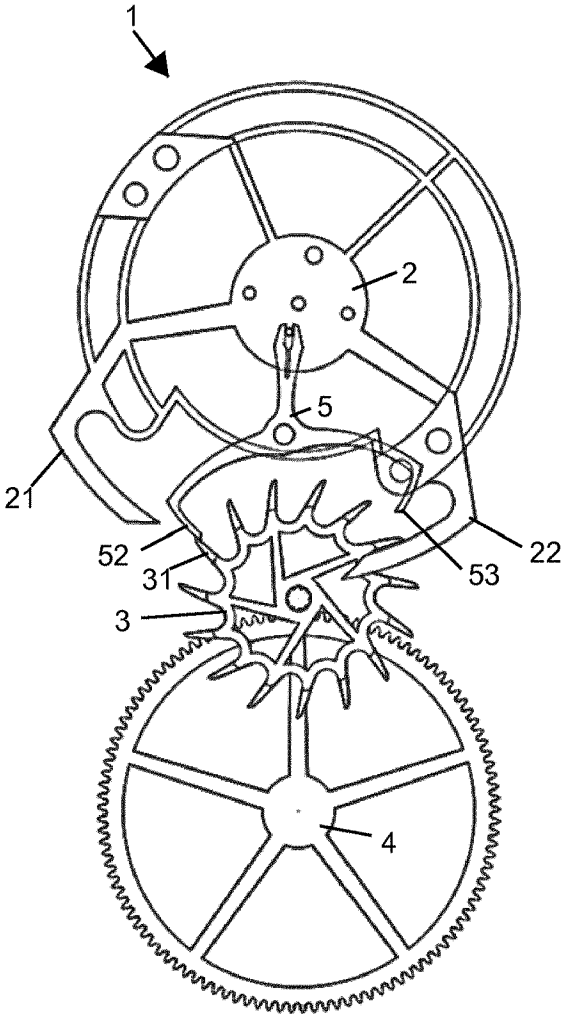
Figure 18:
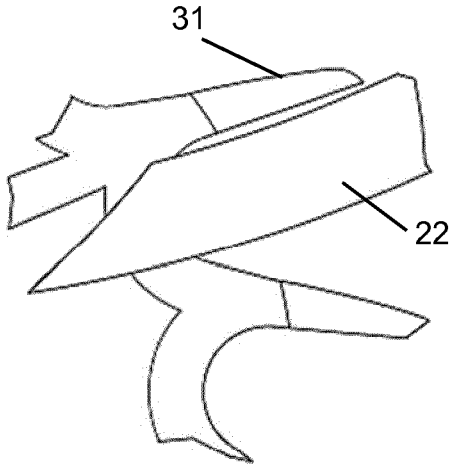
FIGS. 18 to 20 represent enlargements of FIGS. 4, 9 and 17 respectively, showing the passage of an impulse pallet without contact between the teeth of the escapement wheel during the course of the additional arc of a regulating organ associated with the escapement mechanism of the invention.
Figure 19:
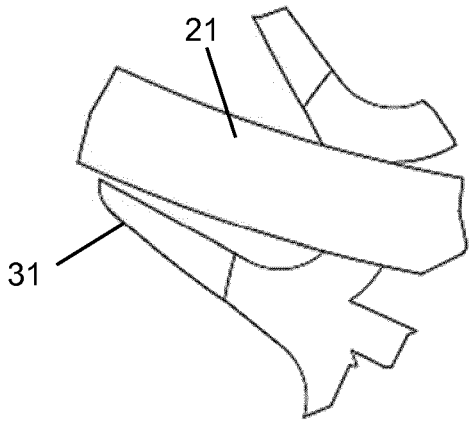

FIG. 2 shows the escapement mechanism 1 in the final impulse position of a tooth 31 of the escapement wheel 3 on the impulse pallet 21 of the regulating organ 2. The torque transmitted by the escapement wheel 3 to the regulating organ 2 via pallet 21 causes the regulating organ 2 to rotate clockwise, which in turn causes the locking anchor 5 to rotate anticlockwise thanks to the connection of the back connecting member 51 of the anchor to pin 6 near the axis of rotation of the regulating organ 2. This rotation of the locking anchor 5 brings the locking pallet 52 into the locking position against tooth 31 which has just transmitted the impulse to the regulating organ 2, as shown in FIG. 3. The impulse pallet 22 of the balance of the regulating element then follows a circular path between two teeth 31 of the escapement wheel 3, without contact with them (FIG. 18), over this entire alternation, corresponding to the course of the additional arc of the balance in the clockwise direction (FIG. 4).

Figure 9:
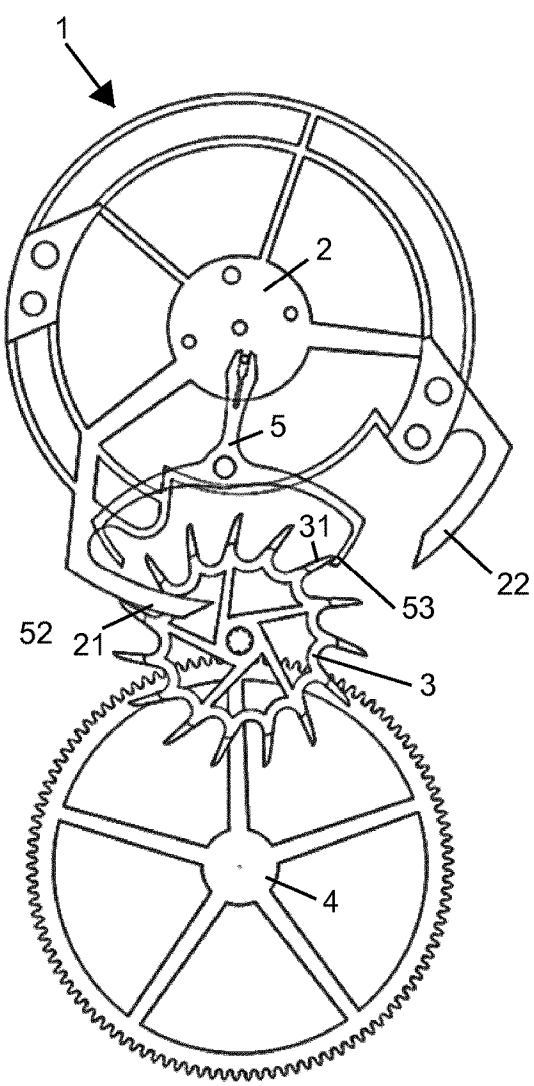
Figure 8:
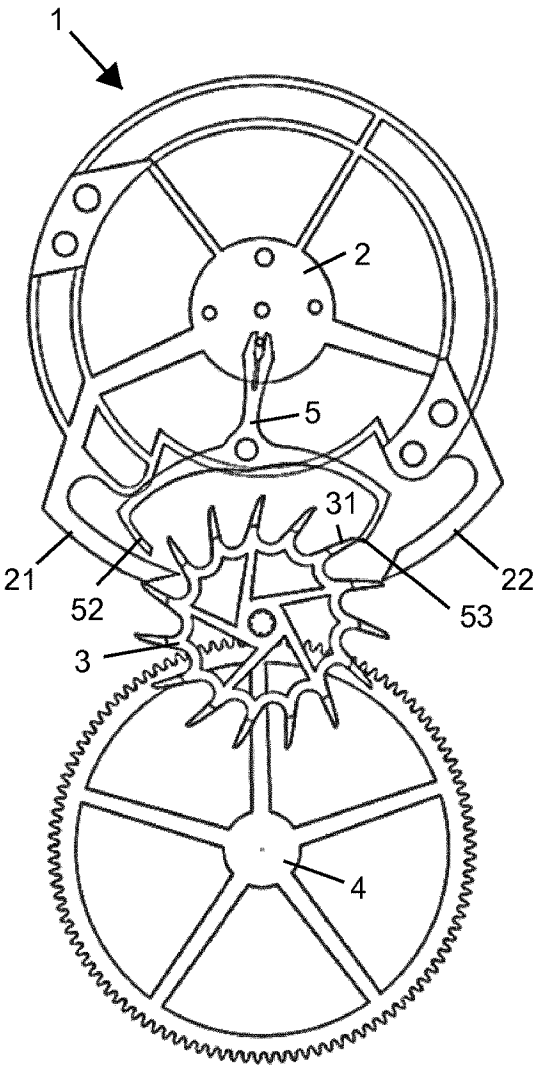
Figure 7:
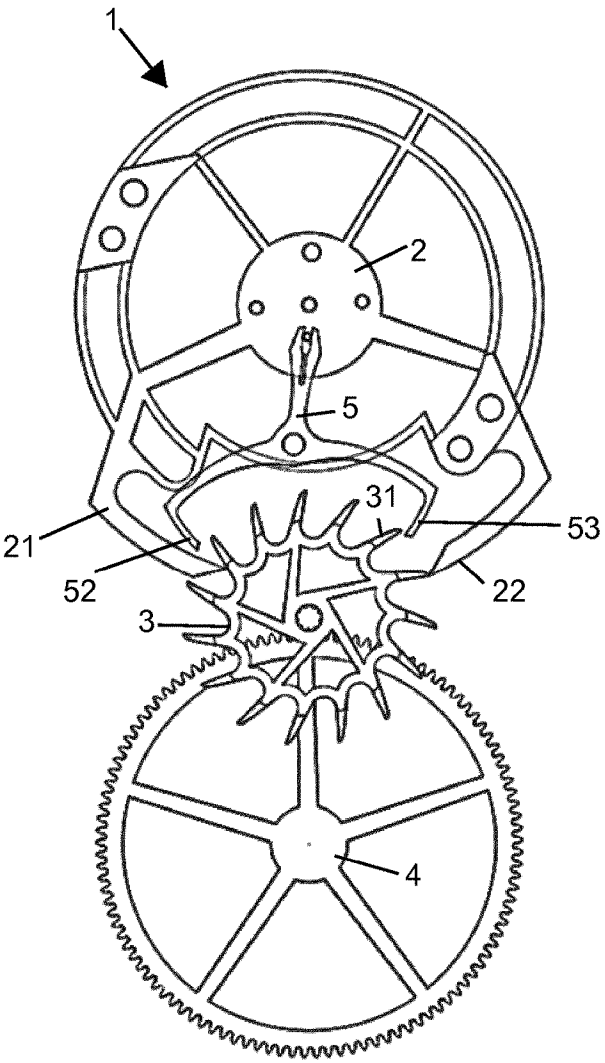
Figure 20:
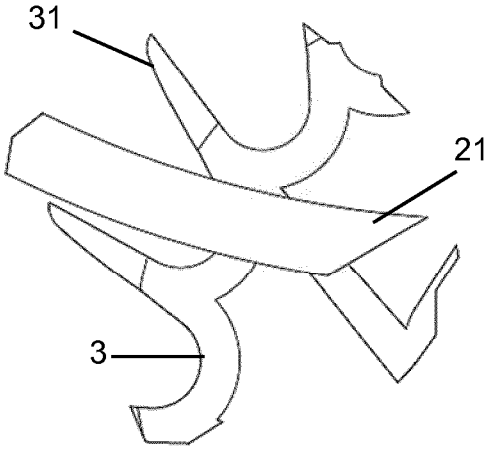

At the end of its additional arc, the balance is returned in a conventional manner in a anticlockwise direction by a return spring (not shown) with which it is associated. This anticlockwise rotation causes the locking anchor 5 to rotate clockwise and the locking pallet 52 to be unlocked from the escapement wheel (FIG. 5), while a tooth 31 of the escapement wheel comes to rest sliding on the impulse plane p of the impulse pallet 22 (FIG. 6), thus starting a second dragging impulse to the balance via the escapement wheel 3. The balance continues its clockwise rotation under this impulse until the end of this second impulse (FIG. 7), which causes the locking anchor 5 to pivot until it is brought to a second locking position in which the second locking pallet 53 is located opposite a tooth of the escapement wheel 3 (FIG. 8), stopping the rotation of the latter. The balance of the regulating organ 2 can then move its additional arc anticlockwise, during which the impulse pallet 21 moves between two teeth 31 of the escapement wheel 3 at locking, as shown in FIGS. 9 and 20. Thus it can be noted that during the locking phases, the escapement wheel has contact only with the locking anchor 5 and not with the impulse pallets 21, 22. At the end of this second alternation, the regulating organ starts again clockwise and so on according to the cycle described above in FIGS. 2 to 9.

FIGS. 10 to 17 additionally represent the operation of a single-beat embodiment of the escapement mechanism 1 of the invention in which the escapement mechanism has only one impulse pallet 21.

Figure 12:
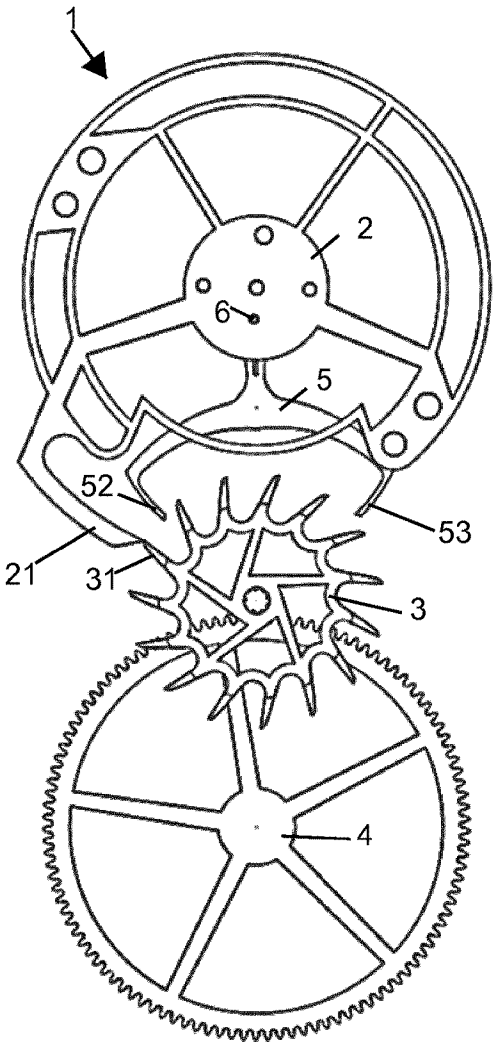
FIGS. 10 to 17 show a variant of the embodiment of the escapement mechanism according to the invention in a single-beat form and its different positions and operating phases over a complete oscillation of the balance of the associated regulating organ.
Figure 11:
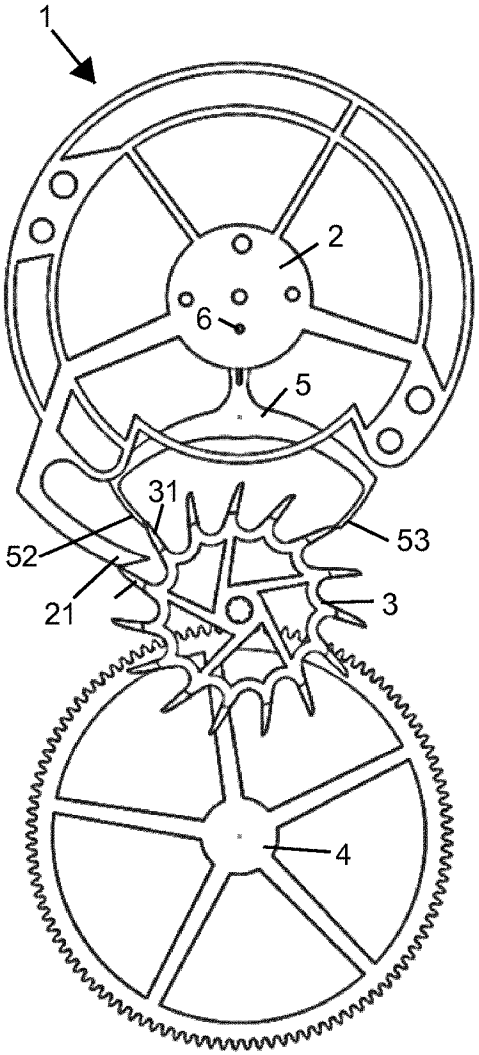
Figure 10:
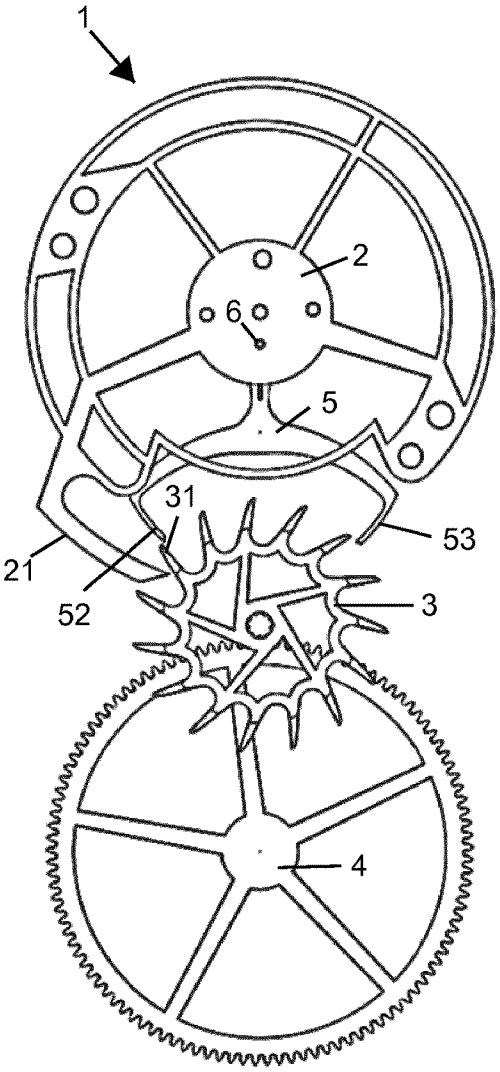
Figure 14:
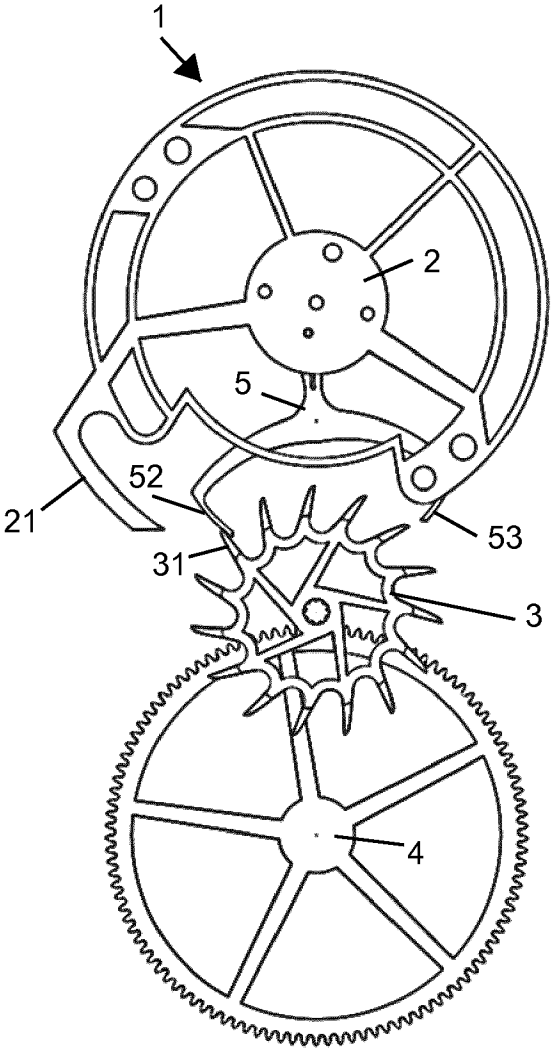
Figure 13:
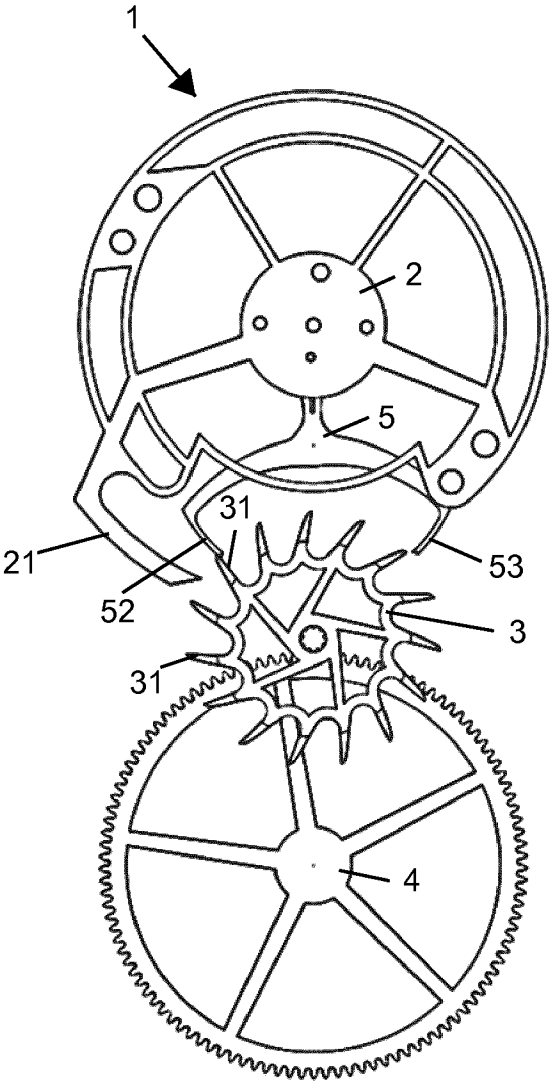
Figure 17:
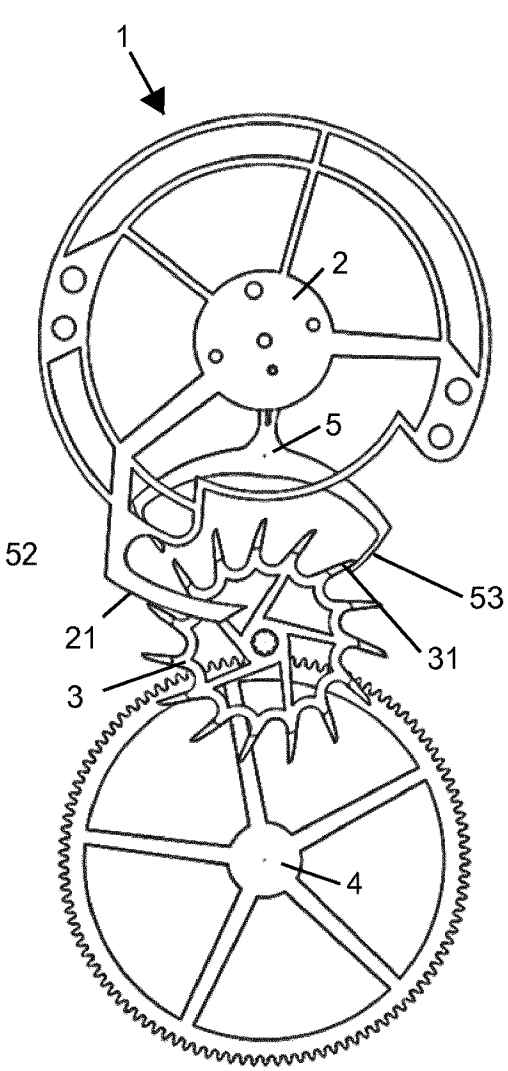
Figure 16:
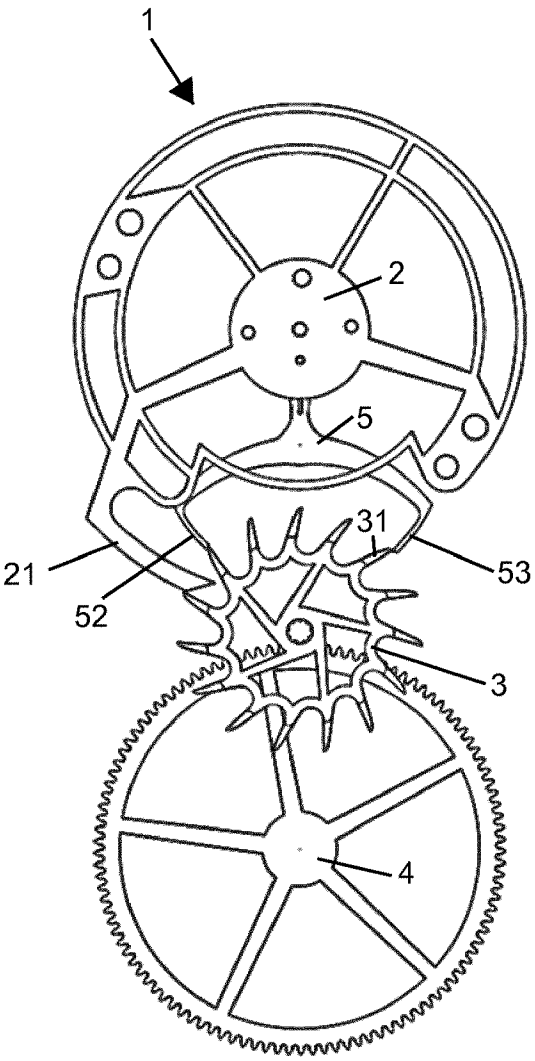
Figure 15:
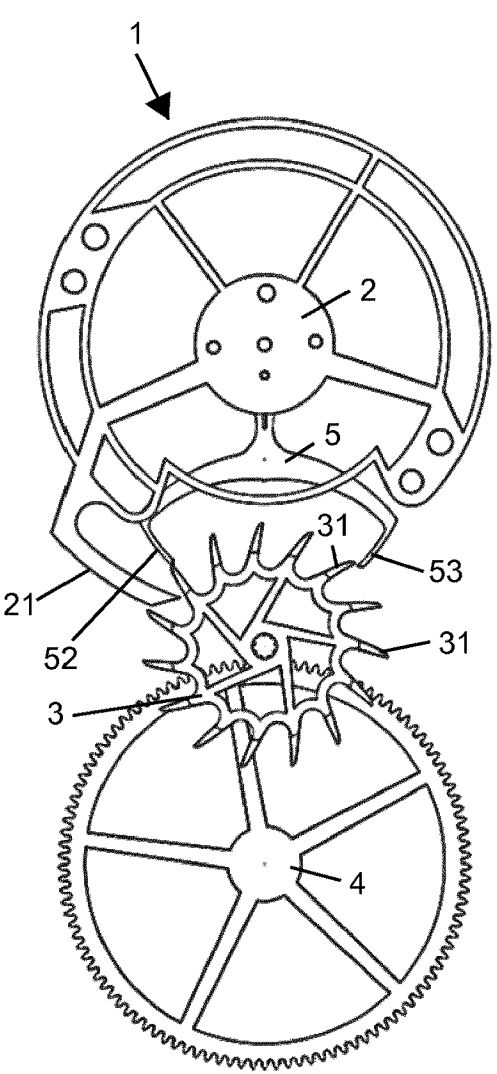

FIG. 10 shows this second single-beat version of the escapement 1 of the invention in dead centre position, similarly to FIG. 1. From this dead centre position, the gear wheel 4 drives the escapement wheel 3 in a clockwise direction, which brings a tooth 31 of said wheel against the impulse plane p of the single impulse pallet (FIG. 11) to transmit an impulse to the regulating organ 2. This dragging impulse also causes the regulating organ 2 to rotate clockwise and thus the locking anchor 5 to rotate anticlockwise on its axis, thus bringing the locking pallet 52 in the first locking position (FIG. 13) to a tooth 31 of the escapement wheel 3 at the end of the impulse (FIG. 12). The regulating organ 2 then makes a first alternation clockwise (FIG. 14) and then returns anticlockwise to the dead centre position (FIG. 15) by the simple return force of the associated return spring. The regulating organ 2 carrying the single impulse pallet 21 then makes its single beat between two teeth 31 of the escapement wheel (FIGS. 16 and 20), which, when passing through the dead centre position, causes the locking anchor 5 to rotate clockwise, bringing the second locking pallet 53 to the second locking position to prevent the rotation of the escapement wheel during the single beat and the second complete alternation of the balance, as shown in FIG. 17, which then returns in the opposite direction in the conventional manner, and so on.

In this configuration, an even less disturbance of the regulating organ 2 is obtained with considerably reduced dragging impulse and locking phases and thus a better efficiency of the escapement of the invention.

The invention thus offers an escapement mechanism with a simple, reliable and space-saving structure, adapted to low amplitude oscillations and high frequencies of the regulating organ of a watch mechanism, which can be used in watch mechanisms as well as in clock mechanisms by singularly improving the performance of these mechanisms in comparison with hitherto known dragging locking escapements.

The invention claimed is:

1. An escapement mechanism for a timepiece having a regulating organ of the sprung balance type, the escapement mechanism comprising:

an escapement wheel rotatable about a first axis of rotation and having a series of peripheral teeth, and a locking anchor, rotatable about a second axis of rotation parallel to the first axis of rotation, said locking anchor comprising first and second locking pallets arranged respectively at one end of first and second arms and arranged for alternately engaging a tooth of the escapement wheel at each rotation step of the escapement wheel and of the locking anchor about their respective axis of rotation, wherein the escapement mechanism comprises at least one impulse pallet adapted to be fixed to one said regulating organ to transmit an impulse by sliding the tooth of the escapement wheel on an impulse plane of said impulse pallet once at least every two alternations of said regulating organ, and wherein the locking anchor comprises a connecting member for permanent kinematic engagement in rotation to said regulating organ so as to provide a lever arm between the axis of rotation of the regulating organ and the escapement wheel.

2. The escapement mechanism according to claim 1, wherein the locking anchor and the at least one impulse pallet are arranged opposite the escapement wheel in such a way that, in a "dead centre" position, outside the locking or impulse phases, the locking pallets are located at a distance from the axis of rotation of the escapement wheel greater than the radius of the circumcircle of the teeth of said escapement wheel, while at least one end of the at least one impulse pallet is located at a distance from the axis of rotation of the escapement wheel less than said radius.

3. The escapement mechanism according to claim 1, wherein the teeth of the escapement wheel have a thickness, considered in the plane of said escapement wheel perpendicular to escapement wheel's axis of rotation, greater than that of the felloe of the escapement wheel from which they extend.

4. The escapement mechanism according to claim 1, wherein the locking anchor comprises the connecting member for permanent kinematic engagement to said regulating organ arranged at the end of an arm extending opposite the locking pallets.

5. The escapement mechanism according to claim 4, wherein said connecting member comprises a slide capable of receiving a pin, a stud, or a lug intended to be fixed to said regulating organ to produce a sliding pivot connection between the locking anchor and said regulating organ.

6. The escapement mechanism according to claim 5, wherein said slide is machined into the mass at the end of the connecting member of the locking anchor.

7. The escapement mechanism according to claim 5, wherein said slide is constituted by a closed or open groove or bleed.

8. The escapement mechanism according to claim 1, wherein the at least one impulse pallet consists of a single impulse pallet.

9. The escapement mechanism according to claim 1, wherein the at least one impulse pallet consists of two impulse pallets capable of being fixed symmetrically on said regulating organ with respect to a straight line passing through the axes of rotation of said regulating organ and of said escapement wheel in said "dead centre" position.

10. A timepiece, comprising:

a watch movement equipped with a mechanical driving source, a finishing gear train, a regulating organ, and an escapement mechanism having an escapement wheel rotatable about a first axis of rotation and having a series of peripheral teeth, and a locking anchor rotatable about a second axis of rotation parallel to the first axis of rotation, said locking anchor comprising first and second locking pallets arranged respectively at one end of first and second arms and arranged for alternately engaging a tooth of the escapement wheel at each rotation step of the escapement wheel and of the locking anchor about their respective axis of rotation, wherein the escapement mechanism comprises at least one impulse pallet adapted to be fixed to one said regulating organ to transmit an impulse by sliding the tooth of the escapement wheel on an impulse plane of said impulse pallet once at least every two alternations of said regulating organ, wherein the locking anchor comprises a connecting member for permanent kinematic engagement in rotation to said regulating organ so as to provide a lever arm between the axis of rotation of the regulating organ and the escapement wheel, the escapement mechanism arranged in kinematic engagement by the escapement wheel to a wheel of the finishing gear train and by the connecting member providing the permanent connection of the locking anchor to said regulating organ, the at least one said impulse pallet of the escapement mechanism being furthermore fixed to said regulating organ so as to periodically receive a share of mechanical energy from the driving source per dragging impulse of the tooth of the escapement wheel on the impulse plane of the impulse pallet.

11. The escapement mechanism according to claim 2, wherein the teeth of the escapement wheel have a thickness, considered in the plane of said escapement wheel perpendicular to escapement wheel's axis of rotation, greater than that of the felloe of the escapement wheel from which they extend.

12. The escapement mechanism according to claim 2, wherein the locking anchor comprises the connecting member for permanent kinematic engagement to said regulating organ arranged at the end of an arm extending opposite the locking pallets.

13. The escapement mechanism according to claim 3, wherein the locking anchor comprises the connecting member for permanent kinematic engagement to said regulating organ arranged at the end of an arm extending opposite the locking pallets.

14. The escapement mechanism according to claim 6, wherein said slide is constituted by a closed or open groove or bleed.

15. The escapement mechanism according to claim 2, further comprising a single impulse pallet.

16. The escapement mechanism according to claim 3, wherein the at least one impulse pallet consists of a single impulse pallet.

17. The escapement mechanism according to claim 4, wherein the at least one impulse pallet consists of a single impulse pallet.

18. The escapement mechanism according to claim 5, wherein the at least one impulse pallet consists of a single impulse pallet.

19. The escapement mechanism according to claim 6, wherein the at least one impulse pallet consists of a single impulse pallet.

20. The escapement mechanism according to claim 7, wherein the at least one impulse pallet consists of a single impulse pallet.

* * * * *